US009630082B2

(12) United States Patent
Zents

(10) Patent No.: US 9,630,082 B2
(45) Date of Patent: Apr. 25, 2017

(54) ATHLETIC PROTECTIVE MOUTHPIECE AND LIP SHIELD APPARATUS

(71) Applicant: Shawn Alan Zents, Simi Valley, CA (US)

(72) Inventor: Shawn Alan Zents, Simi Valley, CA (US)

( * ) Notice: Subject to any disclaimer, the term of this patent is extended or adjusted under 35 U.S.C. 154(b) by 279 days.

(21) Appl. No.: 14/164,754

(22) Filed: Jan. 27, 2014

(65) Prior Publication Data

US 2015/0209645 A1 Jul. 30, 2015
US 2016/0339324 A9 Nov. 24, 2016

Related U.S. Application Data

(60) Provisional application No. 61/763,150, filed on Feb. 11, 2013.

(51) Int. Cl.

| | |
|---|---|
| ***A61C 5/14*** | (2006.01) |
| ***A63B 71/08*** | (2006.01) |
| ***A42B 3/20*** | (2006.01) |
| *A63B 102/24* | (2015.01) |
| *A63B 102/14* | (2015.01) |

(52) U.S. Cl.

CPC ..... *A63B 71/085* (2013.01); *A42B 3/20* (2013.01); *A63B 2071/086* (2013.01); *A63B 2071/088* (2013.01); *A63B 2102/14* (2015.10); *A63B 2102/24* (2015.10); *A63B 2243/007* (2013.01)

(58) Field of Classification Search

CPC ..... A61M 16/06; A61M 16/0057; A61M 16/0463; A61M 16/0493; A61M 16/0622; A61M 16/08; A61M 16/0841; A61M 16/0875; A61M 16/0048; A61M 16/0611; A61M 16/0616; A61M 16/0666; A61M 16/0683; A42B 3/121; A42B 3/281; A62B 18/04; A62B 33/00; A62B 1/08; A62B 18/08; A62B 19/00; A62B 9/00; A62B 9/04; A63B 71/085; A63B 2071/088; A63B 2208/03; A63B 2209/10; A63B 2213/005

USPC ..... 128/848, 859–862; 602/902

See application file for complete search history.

(56) References Cited

U.S. PATENT DOCUMENTS

| | | | |
|---|---|---|---|
| 2,589,504 | A | 6/1950 | Miller |
| 3,082,765 | A | 3/1963 | Helmer |
| 3,203,417 | A | 8/1965 | Helmer |
| 3,682,164 | A | 8/1972 | Miller |

(Continued)

*Primary Examiner* — Michael Brown

(74) *Attorney, Agent, or Firm* — Kelly & Kelley, LLP

(57) ABSTRACT

This invention is an athletic protective mouthpiece and lip shield apparatus used in contact sports and is designed to attach to a helmet's chin strap. The mouthpiece, Air Channel, and Lip Shield structures are particularly designed to comfortably protect both upper and lower jaw of the athlete while removing unwanted impact stress from the front teeth (Incisors) and placing such stress to the stronger Cuspid and Molars regions of the athlete's dentures. This invention solves the problems of airflow restriction and impact stress of the front teeth from other athletic mouthpieces by removing the position of the Incisors from atop the breathing orifice to behind said orifice, whereby providing an improved larger non-condensing airway for the passing of unrestricted airflow. The apparatus is designed to pivot and operate by way of an attachment strap affixed to the Lip shield and fitted into an opening on the helmet's chin strap.

14 Claims, 5 Drawing Sheets

(56) References Cited

U.S. PATENT DOCUMENTS

| | | | | |
|---|---|---|---|---|
| 3,692,025 | A * | 9/1972 | Greenberg | 128/857 |
| 3,768,465 | A | 10/1973 | Helmer | |
| 5,277,202 | A * | 1/1994 | Hays | 128/848 |
| 7,451,767 | B2 * | 11/2008 | Keropian | A61F 5/566 128/848 |
| 8,931,488 | B2 * | 1/2015 | Evans | A63B 71/085 128/859 |
| 2012/0174932 | A1 * | 7/2012 | Wilson | 128/861 |
| 2014/0366892 | A1 * | 12/2014 | Mauro | 128/861 |

* cited by examiner

ATHLETIC PROTECTIVE MOUTHPIECE AND LIP SHIELD APPARATUS

CROSS-REFERENCE TO RELATED APPLICATIONS

I hereby claim benefit under Title 35, United States Code, Section 120 of United States patent application Ser. No. 61/763,150 filed 11 Feb. 2013 (hereinafter "Prior Application"). This application is a Provisional Patent application [Legal Relationship] of the Prior Application. The Prior Application is currently pending. The Prior Application is hereby incorporated by reference into this application.

BACKGROUND OF THE INVENTION

Field of the Invention

This invention relates to a sporting good's dental appliance and more particularly to an athletic protective mouthpiece apparatus with a large airway or Air Channel structure connected to a protective Lip Shield. This invention is used by athletes in contact sports, such as but not limited to American Football, Lacrosse, and Ice Hockey, and is designed to be attached to the chinstrap of a football helmet or other protective head structure. In addition, the mouthpiece, Air Channel structure and Lip Shield are particularly designed to comfortably protect both upper and lower jaw of the athlete while removing stress form the front teeth, protecting lips, and maintaining an athlete's airflow capacity without restriction during competition.

Description of the Related Art

Any discussion of the prior art throughout the specification should in no way be considered as an admission that such prior art is widely known or forms part of common general knowledge in the field.

Various types of athletic mouth protectors are known to the art. The most common types of athletic mouth protectors known, to the art, and internal to the mouth are 1) Stock or ready made 2) Mouth adapted or "boil and bite" 3) Custom made 4) Dentistry. More specifically and beneficial to our purposes would be to identify the conventional products (prior art) that contain a combined lip shield and mouthguard, and then describe the known problems with said prior art, and conclude by describing how the current Patent application's inventive material overcomes the prior art's inadequacies and is superior to any similar subject matter. For example in U.S. Pat. No. 2,589,504 is a protector for the lips and teeth, however this mouth protector only allows the front teeth to contact with the top and bottom of it's airway structure, putting all the stress on the front teeth during bite, thus leaving the middle and back rows of an athlete's teeth suspended and unprotected. In addition, when this airway is bitten down upon during competition it would condense said airway wherein restricting oxygen flow to athlete. As a result of this method, if a player wanted to call out signals or communicate during competition, for instance, during play of a football game the mouthpiece would eject from players mouth leaving the player open to injury. Also the Prior art suggests at best a strap connected by glue and a snap to the chinstrap. In contrast, my invention connects a protective mouthpiece by way of it's Air Channel structure allowing the athlete's lips to rest comfortably around the Air Channel structure while the middle and back teeth are protected by the mouthpiece's tooth pads. Also, the current invention, permits the front teeth to be protected from direct contact and yet left in a suspended position above the internal airway opening, creating a more relaxed jaw position while the stronger aligned middle and back rows of teeth take the stress from impact during jaw contraction in competition. This invention will attach a connected short strap and foot structure to the helmets chinstrap by hole or other similar opening.

In U.S. Pat. No. 3,082,765 contains a lip shield and a U-shaped mouthpiece with small thin airways wherein the front teeth bite down upon from above, and is attached to the helmet's chinstrap by way of a string or cord.

In U.S. Pat. No. 3,203,417 has a small lip protector, inadequate multiple thin airway openings, and no support for middle and back rows of athlete's teeth. Similar contrasting arguments could be made as in [0004].

In U.S. Pat. Nos. 3,682,164 and 3,692,025 contain connective straps which attaches to a players helmet's face mask, a lip protector, and a mouthpiece with no breathing airways which would restrict an athletes oxygen intake.

And finally, in U.S. Pat. No. 3,768,465 is constructed with a smaller airway divided by a middle bridge within the airway thus creating some restriction of air to the athlete. Also, pertaining to this related art, the athletes' mouth bites down above it's airway, as opposed to my invention in which the teeth are never placed on top of the Air Channel; consequentially, there is never a chance of condensing the athletes airway. Also the prior related art contains a long strap above its airway openings attaching around the bars of a helmet's face mask, in contrast to my invention's smaller strap descending in a downward direction and connecting into a chinstrap.

BRIEF SUMMARY OF THE INVENTION

The Athletic Protective Mouthpiece and Lip Shield Apparatus of the present invention overcomes the problems associated with prior art. The main objectives of present invention is to provide an improved protective mouthpiece for teeth and lips without any breathing restrictions is as follows: 1) to provide an improved large airway or Air Channel structure by which a protective Lip Shield and mouthpiece connects to said Air Channel structure, and a short strap with a foot attachment structure descends from said Lip Shield to attach to the helmet's chinstrap. 2) to improve the comfort of the mouth by suspending front teeth behind the opening of the Air Channel's internal structure thus removing stress and contact from front teeth to the athlete's middle to back teeth allowing a more relaxed jaw position while running or sprinting, and a stronger protective jaw position during bite reflex while in contact or collision with opposing players. 3) to improve breathing and allow no restriction of oxygen flow to the athlete by way of a non-condensing Air Channel. 4) to improve upon a players ability to speak and communicate while protective apparatus is in use without it being ejected from a players mouth. 5) to provide an improved attachment strap and foot that will pivot from the helmet's chinstrap allowing the protective mouthpiece and lip shield apparatus to enter and exit the mouth more readily.

The athletic mouthpiece and lip shield apparatus for the protection of the lips, and upper and lower teeth of a person wearing a helmet having a chin strap affixed thereto, generally comprises:

a) a circular midsection or air channel structure containing a large breathing orifice extending therethrough for the passing of unrestricted airflow to and from the mouth of said person;

b) a protective mouthpiece is formed in a U-shaped appearance, as to correspond to the curvature of the mouth, formed by two resilient tooth pad structures connected to and extending from said breathing orifice or air channel structure on opposite sides of said orifice upon which the middle and back rows of the user's dentures are protectively positioned while aligned with individualized oval tooth mound structures for comfort and individual tooth cushioning;

c) a longitudinally curved resilient protective lip shield member that curves rearwardly and is affixed on the forward end of said air channel structure, wherein said member being of such length and width as to extend fully over the lips and corners of the mouth of said user thereof, in which said lip shield is generally oval in shape and thin in nature containing the large breathing orifice of the air channel structure;

d) a resilient connective strap member affixed to said lip shield member extending downwardly, ending with an attachment member affixed thereto, having attaching means for connection with helmet's chin strap; and e) all parts of said protective mouthpiece and lip shield apparatus being formed of a firm but flexible resilient material therein.

The mouthpiece apparatus' U-shaped tooth pads contain individualized protective oval tooth mound structures to further assist with impact absorption thereto, as well as internal tooth ridge structures which run along the back side edge of said user's molars thereby helping maintain proper tooth alignment while in use.

An athletic protective mouthpiece and lip shield apparatus as defined in claim 1, wherein said air channel structure is constructed with a lip flange for means of insertion between the lips and the outer frontal surface of the teeth of said user.

The user's dentures, or more particularly the molars and cuspid (canine), both top and bottom, when in proper position are protectively supported by the mouthpiece's tooth pad structures thereby, allowing the incisors (front teeth) to suspend freely, in a relaxed and a protective position behind said lip flange.

The mouthpiece apparatus contains a single large breathing orifice or air channel whereby, the thickness of said air channel structure will be such as to not restrict airflow to the user in anyway when said user's lips create downward pressure while in use.

The protective mouthpiece apparatus may be represented as a ready-made or non-customized boil and bite procedure fitted mouthpiece.

The method of use of said protective mouthpiece apparatus is to be affixed to the chin strap of the user's helmet, by way of it's resilient connective strap leg member thereto, originating from the lip shield and ending with the attachment foot structure designed to fit into an opening on the user's chin strap, whereby creating a pivot point from which said strap leg member and attachment foot structure will permit the protective mouthpiece apparatus to enter and exit the user's mouth freely.

The preferred method of manufacture of said protective mouthpiece apparatus is a one piece molding of an elastomer such as, but not limited to, rubber or plastic thereof, having Durometer reading in the range of 40-70 with a Shore A hardness thereto, for user's safety a preferred FDA approved compounding material for production.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

DETAILED DESCRIPTION OF A PREFERRED EMBODIMENT OF THE INVENTION

Figure 1:
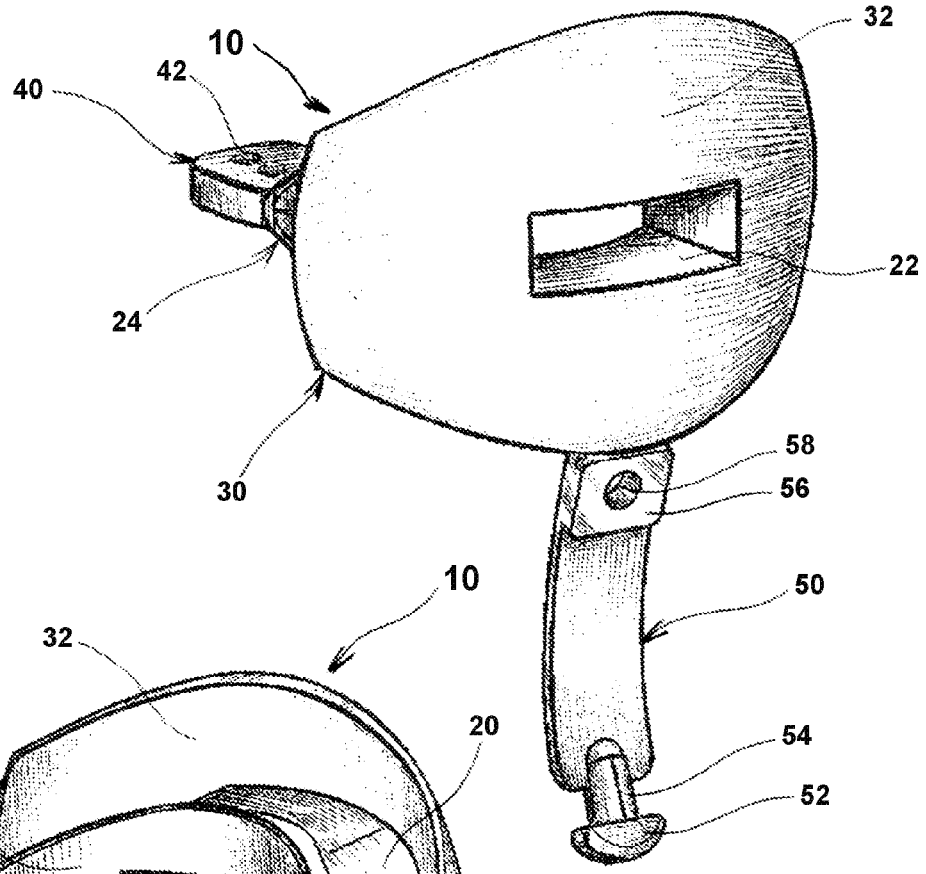
FIG. 1 is a three-quarter frontal perspective view of the present Athletic Protective Mouthpiece and Lip Shield Apparatus illustrating the structures that make up the preferred embodiments.
Figure 9:
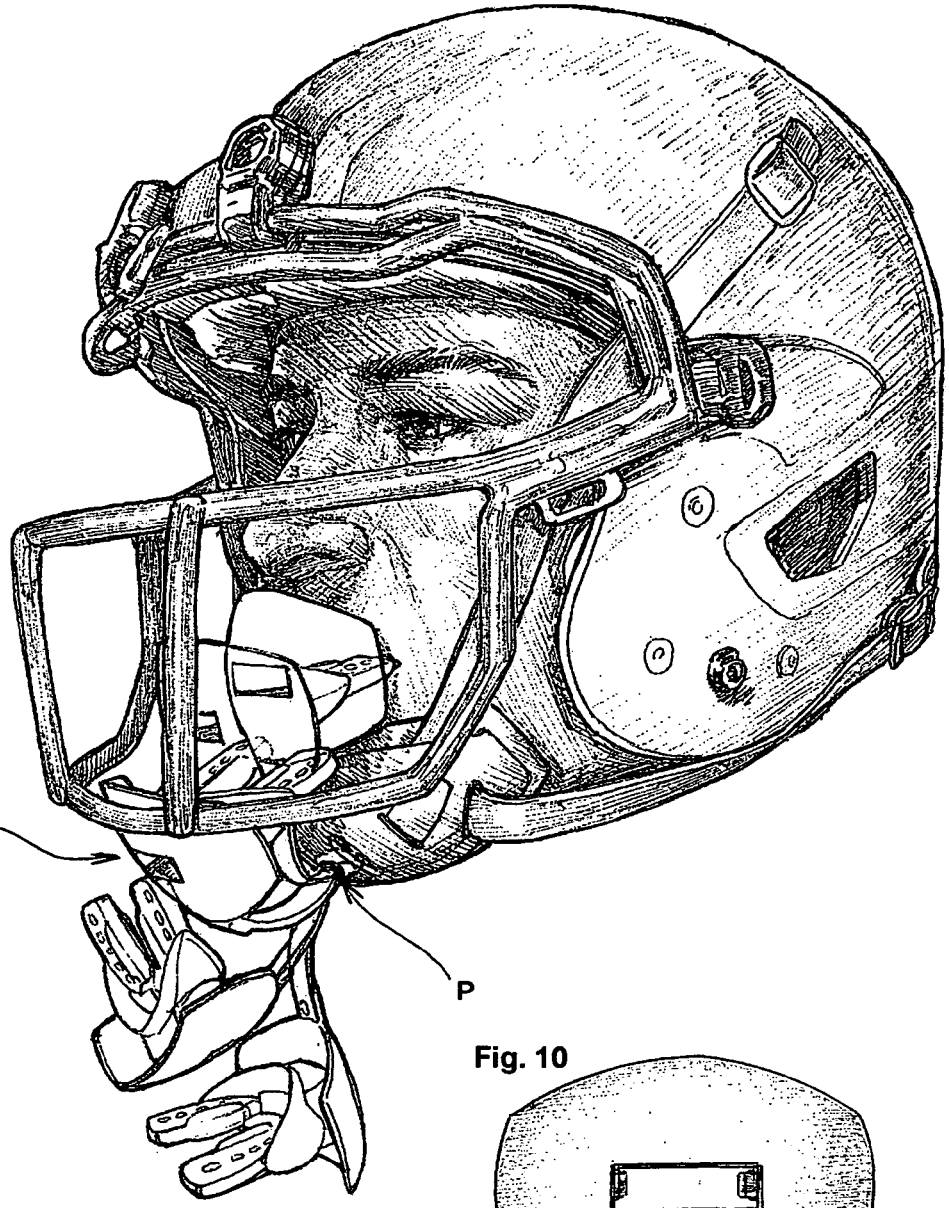
FIG. 9 is an illustrated example of how the present invention might appear when in use by an athlete in American Football; thus demonstrating how the attachment Foot structure would insert into a hole on the Helmet's chin strap and create a pivot point from which the protective Mouthpiece and Lip Shield, shown in FIG. 1, would enter and exit the player's mouth.

Overview: In FIG. 1 a preferred form of the athletic protective mouthpiece and lip shield embodying the present invention, generally designated 10, includes a circular mid-section or Air Channel structure 20, connected to a protective Lip Shield 30, similarly, connected to the Air Channel structure, extends two protective mouthpiece Tooth Pads 40, with a short strap leg extending downward 50 that will connect and pivot P with the helmet's chin strap, as is shown in FIG. 9; the athletic protective Mouthpiece and Lip Shield 10 should be constructed or molded, preferably, from a firm but flexible FDA approved compounding material.

Figure 2:
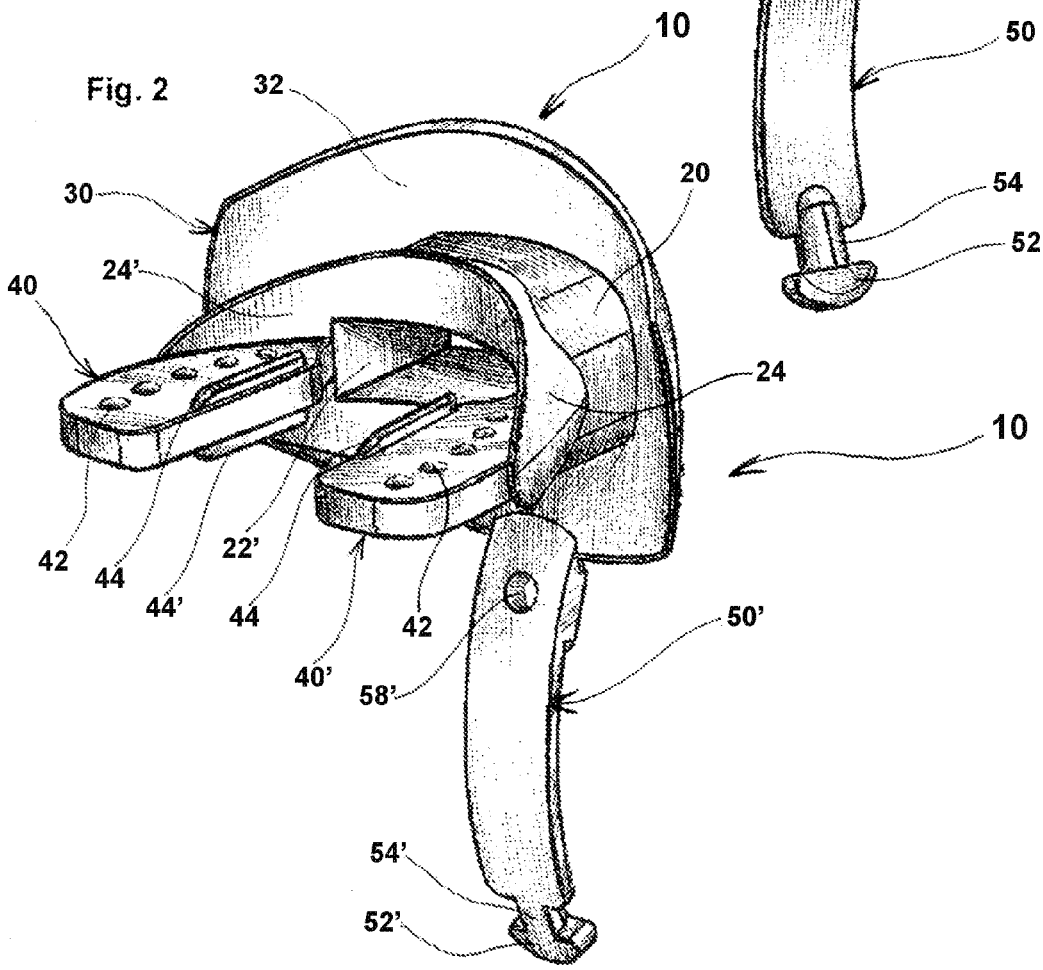
FIG. 2 is a three-quarter rear perspective view of the present protective mouthpiece and lip shield as shown in FIG. 1.
Figure 3:
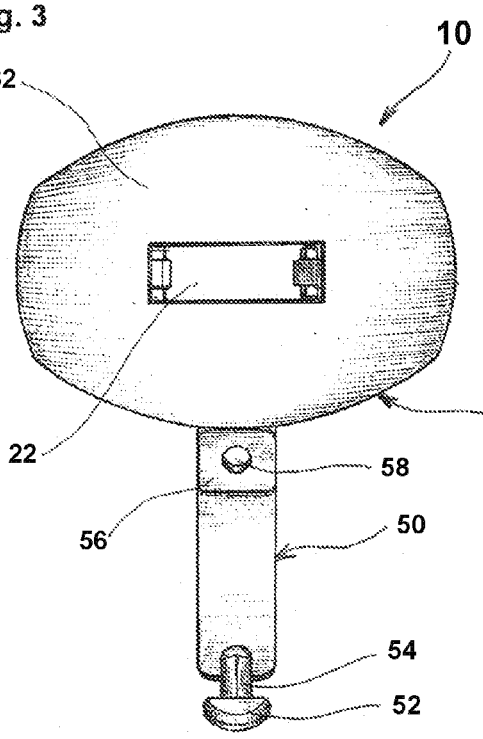
FIG. 3 is a front view representing the present invention as shown in FIG. 1.

Structures: Referring now in detail to the drawings of the preferred embodiment of the mouthpiece 10, as best shown in FIGS. 1-8 as constructed or more particularly molded around the Air Channel Structure 20 containing a singular large breathing orifice 22, in which the preferred shape of this orifice is rectangular in design, but not limited to said shape. This orifice originates and follows the curvature of the front of the Lip Shield 30, and continues inward surrounded by the circular Air Channel structure 20 of FIG. 2, which the athlete's lips contact and rest upon when in use by a player, as best illustrated in FIG. 9, FIG. 11 and FIG. 12. additionally, part of the Air Channel's structure is a protective lip flange structure 24 which helps to protect the front teeth and gums from the rear side of said lip flange structure 24', as well as support and stabilize the mouthpiece's Tooth Pads 40 as they connect and extend outward from said Air Channel, as represented in FIG. 2, FIG. 5 and FIG. 8. finally, the thickness of the Air Channel should be enough that it would not restrict airflow in anyway when an athlete's lips create downward pressure while in use, as shown in FIG. 9, FIG. 11 and FIG. 12.

Figure 4:
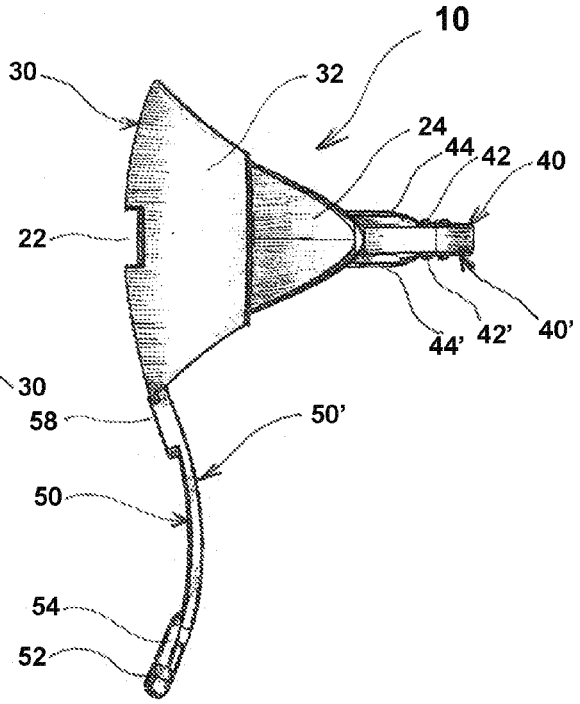
FIG. 4 is a profile left side view representing the present invention as shown in FIG. 1.
Figure 5:
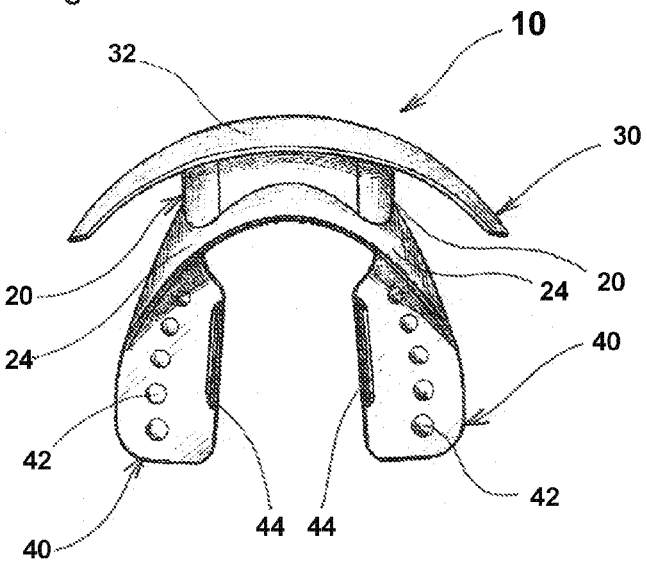
FIG. 5 is a top plan view representing the preferred embodiment of present invention as shown in FIG. 1.
Figure 6:
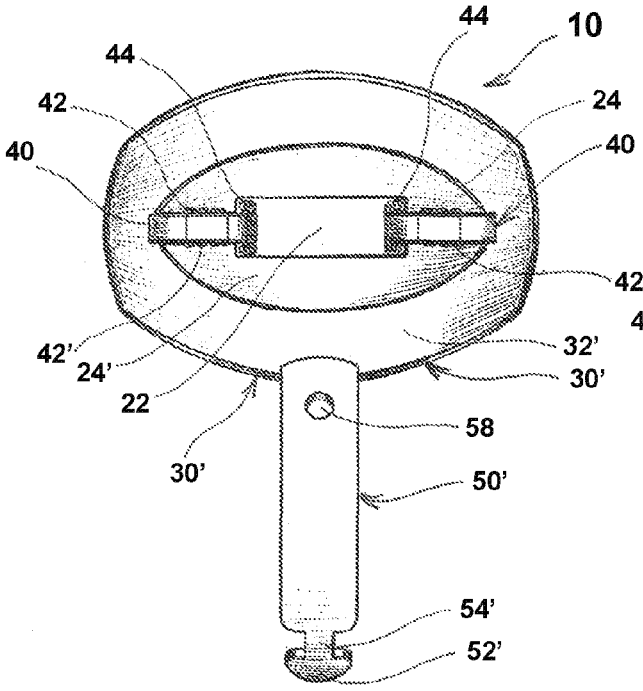
FIG. 6 is a back view representing the present invention as shown in FIG. 1.
Figure 7:
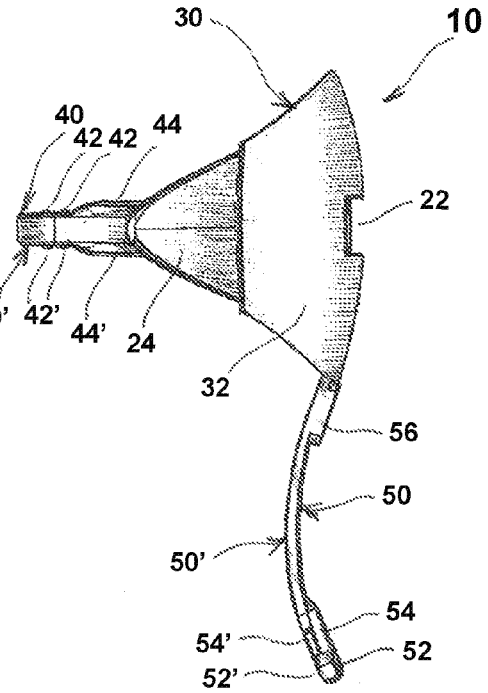
FIG. 7 is a profile right side view representing the present invention as shown in FIG. 1.
Figure 8:
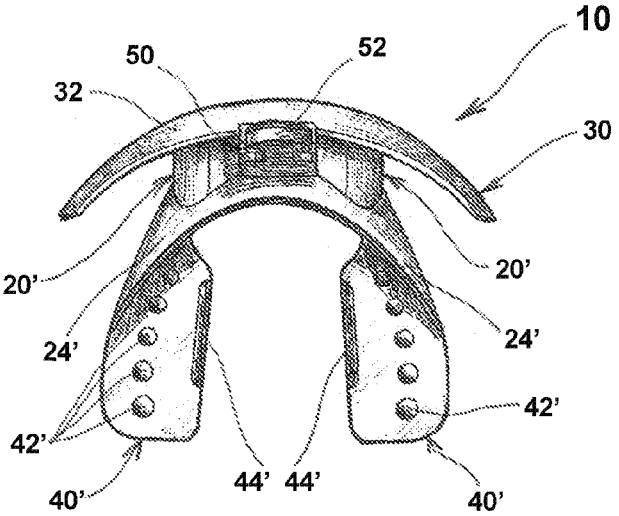
FIG. 8 is bottom view representing the present invention as shown in FIG. 1.
Figure 11:
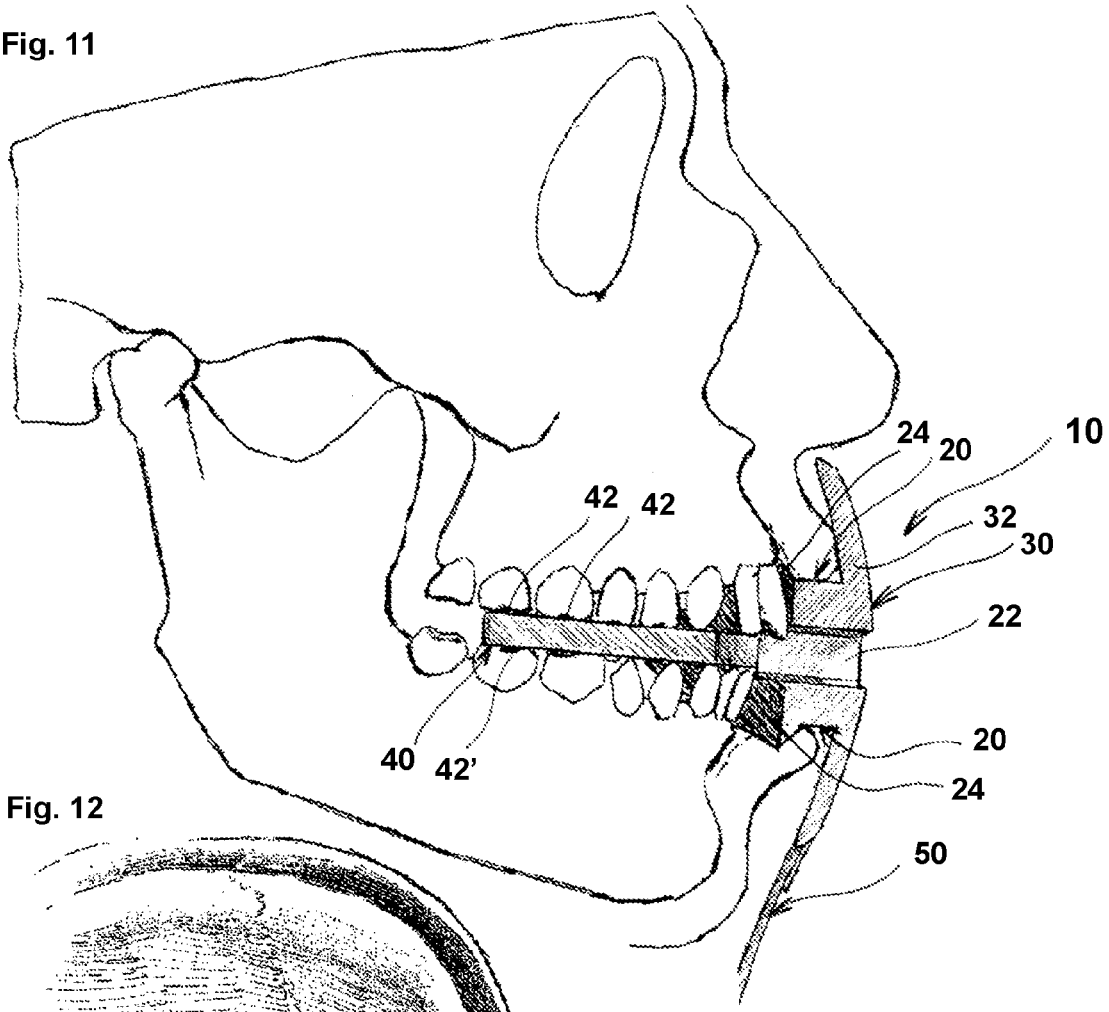
FIG. 11 is a cross-sectional view of the present invention of FIG. 1 in a profile side view image of an anatomical illustration demonstrating the correct position of the protective Mouthpiece and Lip Shield apparatus while inserted within a player's mouth.
Figure 12:
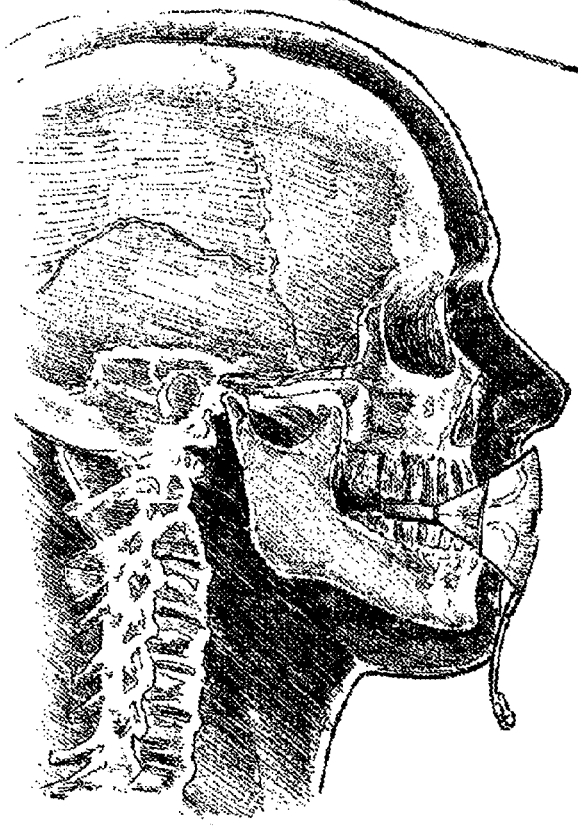
FIG. 12 is a profile side view rendering illustrating the protective features of the present invention, shown in FIG. 1, upon the anatomical structures of the player's lips, dentures, and lower jaw while in position.

The Lip Shield structure 30 curves convexly around the athlete's mouth and lips protecting the anatomy of the Orbicularis Oris muscle from direct contact, as shown in FIG. 11, additionally, the Lip Shield 30 curves slightly longitudinally 32 to conform to the tooth cylinder of the skull, as best demonstrated in FIG. 11, FIG. 4, FIG. 7; the preferred shape of the Shield 30 is generally oval, but not limited to said shape, with curved angles at it's left and right outside edges, as might be seen in FIG. 1, FIG. 2, FIG. 4, and FIG. 7, the shield 30 is fairly thin in nature, approximately ⅛" to ¼" in thickness, tapering to it's ends FIG. 2. The exterior portion of the Lip Shield 30, as best illustrated in frontal views like examples FIG. 1 and FIG. 3, contains the breathing orifice or Air Channel 22 and at the bottom central point of the shield connects the short extending Strap Leg 50 ending with an attachment foot 52. The interior portion of the shield 30' covers and wraps around the corners of the mouth 32' ending below the nostrils and chin areas of the athlete, as shown in FIG. 9, FIG. 11 and FIG. 12. The Lip Shield 30 is the most notable visible attribute of the preferred embodiment of the present invention 10 and should be constructed or more particularly molded with a firm yet flexible cushioning material compounding.

The preferred embodiment of the present invention 10 constructed around the Air Channel Structure 20 which is connected to a protective Lip Shield 30 wherein a mouthpiece in U-shaped appearance as to correspond to the curvature of the mouth 40 extending outwardly from the outer ends of the rear side of the lip flange 24' of previously mentioned Air Channel structure 20 with two protective Tooth Pads 40 which contain small round shaped individualized tooth structures 42 for added comfort and impact absorption, but not solely limited to this shaped design, as well as internal tooth ridge structures 44 in which help keep teeth in place and properly aligned while in use, as best shown in FIG. 2, FIG. 5, and FIG. 8. The inventive nature of this mouthpiece's structure 40 and Air Channel structural design 20 is such as to allow the athlete's front teeth to suspend freely, relaxed, and in a protective position, behind the Air Channel lip flange structure 24 thus allowing the middle and back rows of dentures to carry the stress load while contacting the Tooth Pads 40 during competition, as illustrated in FIG. 11. More notably, the front teeth, both top and bottom, fit up to and most likely against the lip flange 24 of the Air Channel, as shown in FIG. 2, FIG. 11 and FIG. 12 as a result, the mouthpiece structure or Tooth Pads 40 should be molded with a more firm than a more flexible compounding material as to not allow the Tooth Pads 40 to contract, when bitten down upon, wherein not allow the front teeth to contact each other. Therefore, it is preferred that the present invention 10 with said mouthpiece structure 40 be represented as a Ready Made or Non-Moldable mouthpiece, as in FIG. 2. However it could be recommended, if more beneficial, to form a moldable structure on top of this more permanent substructure 40 which may allow a more custom fit by the user.

Figure 10:
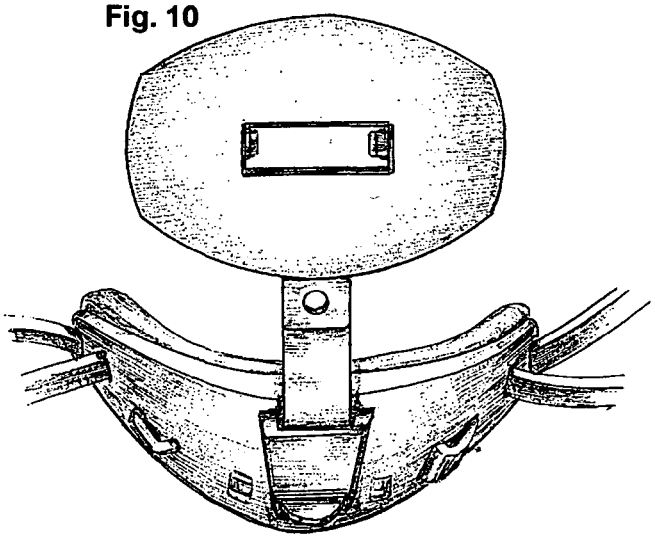
FIG. 10 is a front view illustration demonstrating how the present invention might be attached to helmet's hard shell chin strap.

Methods of attachment: The connective member 50 of the protective Mouthpiece and Lip Shield of the present invention 10 is a short Strap Leg extending from the bottom of the Lip Shield 30 ending with an attachment Foot 52 which is designed to fit into an opening P on the helmet's chin strap, as shown in FIG. 9 and FIG. 10. Within the various views illustrated in the art of the present invention 10 has visualized the preferred embodiment of the attaching Strap Leg mechanism, as represented in FIG. 1, FIG. 2, FIG. 3, FIG. 4, FIG. 6, FIG. 7, and FIG. 8. Including a rectangular component 56 containing a circular opening 58 which is designed to offer alternative attachment methods, if so desired by an athlete, in which another strap or string could be use to attach present invention 10 through the opening 58 to the face mask of the helmet; likewise, component 56 could be used as a looping structure through which the Leg Strap 50 is bent down and around into the chin strap and then back upwardly towards component 58 attaching where the Foot structure 52 could be fitted into and through component 58's opening. The short thin flexible Leg Strap 50 which is represented originating from the bottom of the Lip Shield 30, but not limited to said position, downwardly towards the Chin Strap ending with a small cylindrical structure 54 and attachment Foot 52, the rear side of said structure 50' is one of being more smooth of surface descending continuously from the rear of the Lip Shield 30 above; thus allowing little friction with user's chin or chin strap, as FIG. 2, FIG. 4, and FIG. 7 will illustrate. The intent of such a method of attachment is create a pivot point P as shown in FIG. 9 in which the present invention 10 will be allowed to most advantageously enter and exit the mouth freely, as further illustrated in FIG. 9, without hindrance or restriction, thus being of great benefit to player not having to switch his or her focus to the apparatus verse concentrating on the game at hand. Conversely, all other mouthpieces and protectors on the market today are design with no straps, meaning to be hand held when exited the mouth, or are constructed for attachment to fit around and hang from the helmet's face mask.

Method of Manufacture: In the preferred embodiment of the present invention 10 the entire mouthpiece and lip shield is a one piece molding of an elastomer such as rubber or plastic having a Durometer reading of between approximately 55 and 65 with a Shore A hardness. However, it is believed that a Durometer in the range of 40 to 70 will provide an acceptable mouthpiece. A preferred FDA approved compounding material for production, one that is safe in material, firm and flexible in nature for contact, yet comfortable for use by the athlete.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

Having described and illustrated by word and image the preferred embodiment of the present invention,

What I claim is:

1. An athletic mouthpiece apparatus for use with a helmet having a chin strap, comprising:

an air channel structure;

a shield member disposed adjacent to or extending from the air channel structure;

a first tooth pad extending from the air channel structure away from the shield member;

a second tooth pad extending from the air channel structure away from the shield member;

an air channel extending through the air channel structure and shield intermediate the first and second tooth pads; and a strap extending from a lower portion of the shield and having a foot at an end thereof configured for insertion into an aperture of the chin strap of the helmet.

2. The athletic mouthpiece apparatus of claim 1, wherein the first and second tooth pads are spaced apart from one another to form a gap therebetween generally aligned with the air channel.

3. The athletic mouthpiece apparatus of claim 2, wherein the first and second tooth pads are configured to be inserted between middle and back teeth of a user of the apparatus, and front teeth of the user are suspended in the gap between the first and second tooth pads and generally aligned with the air channel.

4. The athletic mouthpiece apparatus of claim 1, wherein the shield member is generally convex and configured to substantially cover an orbicularis oris muscle of a user of the apparatus.

5. The athletic mouthpiece apparatus of claim 1, including a flange extending from the air channel structure and configured to be disposed between lips and teeth of a user of the apparatus, wherein the flange extends generally between canine teeth of the user.

6. The athletic mouthpiece apparatus of claim 1, wherein an opening of the air channel extends substantially between the first and second tooth pads.

7. The athletic mouthpiece apparatus of claim 6, wherein the air channel comprises a single, generally unobstructed air channel.

8. The athletic mouthpiece apparatus of claim 1, including spaced apart tooth mounds extending from the surface of the tooth pads so as to be generally aligned with teeth depressions of the user.

9. An athletic mouthpiece apparatus for use with a helmet having a chin strap, comprising:

an air channel structure;

a shield member disposed adjacent to or extending from the air channel structure, the shield member being generally convex and configured to substantially cover an orbicularis oris muscle of a user of the apparatus;

a first tooth pad extending from the air channel structure away from the shield member;

a second tooth pad extending from the air channel structure away from the shield member, the second tooth pad being spaced apart from the first tooth pad so as to form a gap therebetween;

a flange extending from the air channel structure and configured to be disposed between lips and teeth of a user of the apparatus;

an air channel extending through the air channel structure and shield to the gap intermediate the first and second tooth pads; and a strap extending from a lower portion of the shield and having a foot at an end thereof configured for insertion into an aperture of the chin strap of the helmet;

wherein an opening of the air channel extends substantially between the first and second tooth pads.

10. The athletic mouthpiece apparatus of claim 9, wherein the air channel comprises a single, generally unobstructed air channel.

11. The athletic mouthpiece apparatus of claim 9, wherein the first and second tooth pads are configured to be inserted between middle and back teeth of a user of the apparatus and front teeth of a user of the apparatus are suspended in the gap between the first and second tooth pads and generally aligned with the air channel.

12. The athletic mouthpiece apparatus of claim 9, wherein the flange extends generally between canine teeth of the user.

13. The athletic mouthpiece apparatus of claim 9, including spaced apart tooth mounds extending from the surface of the tooth pads so as to be generally aligned with teeth depressions of the user.

14. An athletic mouthpiece apparatus for use with a helmet having a chin strap, comprising:

an air channel structure;

a shield member disposed adjacent to or extending from the air channel structure, the shield member being generally convex and configured to substantially cover an orbicularis oris muscle of a user of the apparatus;

a first tooth pad extending from the air channel structure away from the shield member;

a second tooth pad extending from the air channel structure away from the shield member, the second tooth pad being spaced apart from the first tooth pad so as to form a gap therebetween;

spaced apart generally circular tooth mounds extending from the surface of the tooth pads so as to be generally aligned with teeth depressions of the user;

a flange extending from the air channel structure and configured to be disposed between lips and teeth of a user of the apparatus and extend generally between canine teeth of the user;

an air channel extending through the air channel structure and shield to the gap intermediate the first and second tooth pads; and a strap extending from a lower portion of the shield and having a foot at an end thereof configured for insertion into an aperture of the chin strap of the helmet;

wherein an opening of the air channel extends substantially between the first and second tooth pads;

wherein the air channel comprises a single, generally unobstructed air channel; and wherein the first and second tooth pads are configured to be inserted between middle and back teeth of a user of the apparatus, and front teeth of a user of the apparatus are suspended in the gap between the first and second tooth pads and generally aligned with the air channel.

* * * * *